United States Patent [19]

Allan et al.

[11] 4,225,350

[45] Sep. 30, 1980

[54] NON-CHROMATE CONVERSION COATINGS

[75] Inventors: John L. H. Allan, Glen Rock; Philip D. Readio, Sparta; Ajay M. Bengali, Hackensack; Richard F. Zuendt, Oradell, all of N.J.

[73] Assignee: Dart Industries Inc., Los Angeles, Calif.

[21] Appl. No.: 45,161

[22] Filed: Jun. 4, 1979

Related U.S. Application Data

[63] Continuation-in-part of Ser. No. 955,812, Oct. 30, 1978, abandoned.

[51] Int. Cl.[2] ..... C09D 5/08; C23F 7/00

[52] U.S. Cl. ..... 106/14.12; 106/14.21; 106/14.45; 148/6.17; 148/6.24; 148/6.27; 148/31.5; 252/79.4; 252/387; 252/389 A; 428/470

[58] Field of Search ..... 106/14.12, 14.45, 14.21; 148/6.17, 6.24, 6.27, 31.5; 156/665, 666; 422/15, 16, 17; 428/470; 252/387, 389 A, 79.4

[56] References Cited

U.S. PATENT DOCUMENTS

| | | | |
|---|---|---|---|
| 3,663,441 | 5/1972 | Gulla | 252/79.4 |
| 3,668,131 | 6/1972 | Banush et al. | 252/79.4 |
| 4,158,592 | 6/1979 | Readio et al. | 252/79.4 |

*Primary Examiner*—Lorenzo B. Hayes

*Attorney, Agent, or Firm*—Bryant W. Brennan; Harold R. Beck

[57] ABSTRACT

Improved color, brightness and corrosion resistance are imparted to metal surfaces such as zinc plated surfaces, by treatment with a non-toxic solution comprised of sulfuric acid, hydrogen peroxide, a silicate and at least one cationic triarylmethane dye. Certain organophosphorus compound additives further enhance the corrosion resistance.

21 Claims, No Drawings

NON-CHROMATE CONVERSION COATINGS

This application is a continuation-in-part of pending application Ser. No. 955,812, filed Oct. 30, 1978 now abandoned.

BACKGROUND OF THE INVENTION

The formation of chromate conversion coatings on surfaces of various metals, such as zinc and cadmium, is presently the most common technique of imparting increased brightness and corrosion resistance to the metal. In a typical process, the metal work pieces are immersed in an acidic solution containing hexavalent chromium compounds, which react with the metal causing the precipitation of a complex gel-like coating or film of trivalent chromium and entrapped soluble hexavalent chromium compounds onto the metal surface. The coated work pieces are then rinsed and dried under controlled conditions.

There are several serious disadvantages common to all chromate conversion coating processes. One of these is the relatively short life of the process bath expressed in terms of unit surface area coated per unit volume of bath. The main reason for the short life is the continuous build-up in the bath of dissolved trivalent chromium resulting from the oxidation-reduction reactions that occur between the metal and the hexavalent chromium. Trivalent chromium is a contaminant in the process affecting the coating efficiency. Thus, when reduced coating activity is noted, or when the contaminants have built up to a certain predetermined level, a process solution of this type is at least partially replaced with freshly prepared solution, and ultimately completely discarded in favor of a fresh bath.

The disposal of the spent process solution is wasteful, as the solution still contains considerable quantities of hexavalent chromium. Not only does the loss of these values contribute significantly to the overall cost of the coating process, but disposal also adds to this cost in that the solutions present a substantial waste treatment problem. Hexavalent chromium is highly toxic and must be reduced to the trivalent form, e.g. by reaction with sodium hydrosulfite or sodium bisulfite, and is thereafter precipitated from solution by addition of alkalies, such as sodium carbonate or lime. After dewatering of the precipitate by settling or filtration, the concentrated sludge of trivalent chromium hydroxide must be disposed of in specially designated areas, since trivalent chromium is still too toxic to be used as landfill. Substantial waste treatment requirements of spent rinse waters are also created due to dragout of toxic chemicals from the process bath into subsequent rinse waters. Although there are integrated processes for the reoxidation and regeneration of spent chromate solutions and rinse water, the small processor usually finds that the refined and sophisticated techniques involved are neither practical nor economically feasible for solving his waste treatment problems.

In our copending application Ser. No. 955,812, filed Oct. 30, 1978, which application is incorporated into this application by reference, we have disclosed a novel nontoxic conversion coating solution which is comprised of sulfuric acid, hydrogen peroxide and a soluble silicate and optionally containing additives, e.g. certain organophosphorus compounds for further enhancement of corrosion resistance of metal surfaces treated with the solution.

Although the acidic silicate "solution" may or may not be a true solution but rather in the form of a hydrosol, for the purpose of this application, the term "solution" is intended to cover a hydrosol as well as a true solution.

In addition to the formation of conversion coatings of excellent properties, there are many other important advantages of the invention described in the aforementioned application. One of these is the extremely long life of the conversion coating solution before it is discarded in favor of a fresh solution. It has been found that the solutions are capable of treating up to approximately 185 $m^2$ of surface area per liter, which is far superior to the typical value of approximately 20 $m^2/l$ obtained with conventional chromate conversion coating baths.

Another and related advantage is that, apart from some build-up of dissolved metal in the solution, there are detrimental by-products forming and accumulating therein during use, as is the case with conventional chromate conversion coating solutions, in which trivalent chromium rapidly builds up.

The most important advantage, however, is the nontoxic nature of the system, which greatly facilitates waste disposal of spent solutions from the conversion coating process. Rinse waters can usually be disposed of without any treatment required. Spent conversion coating baths are merely treated with lime for neutralization and removal of dissolved metal ions and phosphorus (when organophosphorus promoters are used) as a precipitate. After settling or other separation, the liquid phase may be disposed of safely in common sewers, while the dewatered sludge mainly composed of silicate can be dumped in municipal landfill areas.

One disadvantage, however, is that the resulting conversion coatings, although bright and corrosion resistant, lack the decorative color, usually blue, which is characteristic of chromate conversion coated parts. The incorporation into the silicate conversion coating solution of conventional dyes recommended and used in the industry for coloring chromate conversion coatings failed to impart any lasting color to the coated surfaces, even at very high dye concentrations and prolonged treatment times. Attempts to use these dyes in a water solution as a post-dip treatment after formation of the conversion coatings on the work pieces also failed to impart any color.

In addition, it was found that many of the conventional metal dyes were unstable in the sulfuric acid-hydrogen peroxide-silicate environment resulting in excessive hydrogen peroxide consumption, complete loss of color or a drastic color change of the bath solution.

It is therefore an object of the present invention to provide an improved, stable conversion coating solution which imparts a lasting color to the coated surface.

Another object of the invention is a process for the formation of bright, corrosion resistant, colored conversion coatings onto metallic surfaces.

Still another object is to provide decorative bright corrosion resistant work pieces.

THE INVENTION

We have now discovered that certain dyes which heretofore predominantly have been used in the dyeing of natural fibers such as paper, cotton, wool, silk, etc., when incorporated into a sulfuric acid-hydrogen peroxide-silicate conversion coating solution, unexpectedly impart pleasing and lasting colors to the coated work pieces without detrimentally affecting the corrosion resistance quality of the coating or the stability of the coating solution. The dyes, which are useful in the present invention are cationic triarylmethane dyes.

Thus in accordance with the present invention there is provided a dyeable conversion coating solution which comprises an aqueous solution of from about 0.2 g/l to about 45 g/l of free sulfuric acid, from about 1.5 g/l to about 58 g/l of $H_2O_2$, from about 3 g/l to about 33 g/l of $SiO_2$ and an effective amount of at least one cationic triarylmethane dye.

The $SiO_2$ component is conveniently provided in the form of a soluble silicate, e.g. sodium silicate or potassium silicate, or predetermined contents of $SiO_2$ and $Na_2O$ or $K_2O$. The mole ratios of $SiO_2$ to either $Na_2O$ or $K_2O$ generally range between 1 and 4, and it is preferred to use those silicates wherein the mole ratio is at least about 1.8 and most preferably at least about 2.2. Ammonium or lithium silicates are also useful in providing the $SiO_2$ component.

The triarylmethane dyes used in this invention are well known in the art and are recognized as a separate generic group of dyes having a Colour Index (C.I.) in the range from 42,000 to 44,999. They are commercially available in a wide variety of colors both in solid form or as aqueous solution concentrates with solids contents typically in the 40–50% range. The amount of dye to be added to the conversion coating solution depends obviously on the desired depth of color.

The solution is easily prepared, e.g. by first adding sufficient sulfuric acid to at least a major portion of the makeup water under agitation to provide the desired free $H_2SO_4$ content and taking into account that some of the free acid will be subsequently neutralized by the $Na_2O$ or $K_2O$ portions introduced with the silicate. The silicate is added under agitation to the cooled acidic solution until it is completely dispersed. The peroxide is added and then the dye, preferably in the form of a dilute solution in a minor portion of the water used in the preparation of the conversion coating solution. The sequence of addition can be changed, however, without any detrimental effect, provided that the silicate is acidified with sulfuric acid prior to mixing with the hydrogen peroxide, or peroxide decomposition will occur.

The preferred concentrations of the components in the aqueous solution are from about 1.8 g/l to about 18 g/l of free $H_2SO_4$, from about 7 g/l to about 29 g/l of $H_2O_2$, from about 8 g/l to about 18 g/l of $SiO_2$ and from about 0.05 to about 0.3 g/l of the triarylmethane dye or mixture of dyes.

The solution is useful for forming conversion coatings on various metallic surfaces, such as those of zinc, cadmium, silver, copper, aluminum, magnesium, and zinc alloys.

The most common application is, however, in the formation of conversion coatings on zinc plated articles such as zinc plated steel articles. The zinc plate provides the steel with cathodic protection against corrosion, and the conversion coating further improves the corrosion resistance, reduces the susceptibility to finger markings and enhances the appearance by chemical polishing of the article and by the color imparted by the dye. It is important that the zinc plate deposit is relatively smooth and fine-grained prior to coating, and that the thickness of the plate deposit is at least 0.005 mm since some metal removal occurs when the film is formed. The preferred plate thickness is between about 0.005 mm and about 0.02 mm.

Usually the formation of the conversion coating follows immediately after the last rinse in the plating cycle. Thus, the freshly plated articles are immersed for a period of from about 5 seconds to about 300 seconds into the solution which is maintained at ambient temperatures. For best results, the immersion treatment is carried out for a duration of from about 20 seconds to about 50 seconds in a bath maintained at temperatures not less than about 20° C. and not more than about 35° C. The coated articles are subsequently rinsed, first in cold water and then briefly in warm water to aid drying of the films. The hot water rinse typically has a temperature in the range of from about 60° to about 70° C. The final step of the coating process is a drying step, which is carried out by any means that will neither abrade the soft and then rather fragile film, nor expose it to excessive temperatures, i.e. temperatures higher than about 70° C. The use of circulating warm air or an airblast are examples of suitable means in the drying operation. After drying, the conversion coatings are quite resistant to damage from abrasion and generally do not require the 12–14 hour aging necessary with conventional chromate conversion coatings.

The resulting conversion coatings have very good resistance to corrosion as determined by the accepted accelerated corrosion test ASTM B-117-64. By the use of one or more of certain organic promoters as additives to the solution of sulfuric acid-hydrogen peroxide-silicate the corrosion resistance of the coatings can be further enhanced. The organophosphorus compounds specified hereinafter have been found to be especially useful in this respect.

These promoters are organic phosphorus compounds having the general formula:

$$[X(R_1)_m]_n \cdot [R_2]_p \cdot [X(R_1)_m]_q,$$

wherein

X is a group of the formula

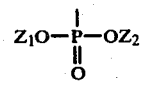

in which $Z_1$ and $Z_2$ independent from each other are hydrogen, sodium or potassium;

m is either 0 or 1;

p is either 0 or 1;

n+q is either (a) 1 when p=0, or (b) equal to the number of available bonds provided by $R_2$ when p=1;

$R_1$ is a (a) $C_1$–$C_4$ alkyl or a $C_1$–$C_4$ hydroxy-substituted alkyl and p=0; and (b) $C_1$–$C_4$ alkylene or a $C_1$–$C_4$ hydroxy-substituted alkylene and p=1;

$R_2$ is selected from (a) N≡, m=1

(b) $=N(CH_2)_rN=$, m=1 and r is an integer from 2 to 6

(c)

$$=N(CH_2)_2 . \underset{\underset{X}{|}}{\underset{(R_1)_m}{N}} . (CH_2)_2N=,$$

m=1 and (d) a $C_1$–$C_4$ alkylene or a $C_1$–$C_4$ hydroxy-substituted alkylene, m=0 or 1.

Examples of these organophosphorus compounds include $C_1$–$C_4$ alkyl phosphonic acids, $C_1$–$C_4$ hydroxyalkalenephosphonic acids, amino tri-$C_1$–$C_4$ alkylene phosphonic acids, $C_2$–$C_8$ alkylene diamine-tetra ($C_1$–$C_4$ alkylene phosphonic acid), diethylenetriamine-penta ($C_1$–$C_4$ alkylene phosphonic acid) as well as the acid or neutral sodium or potassium salts of any of the above-listed phosphonic acids. 1-hydroxyethylidene-1,1-diphosphonic acid is a preferred compound.

The organophosphorus compound or mixture of such compounds is added to the conversion coating solution to provide a concentration therein of from about 0.15 g/l to about 10 g/l, preferably from about 0.5 g/l to about 2 g/l.

During the course of the coating process, the coating solution becomes depleted in both free sulfuric acid and hydrogen peroxide values and must be replenished. Therefore, monitoring of these values should be carried out on a regular basis to assure that the respective concentrations have not fallen below their minima and to assess the amounts needed for replenishment. Free sulfuric acid can be determined by conventional titration methods using sodium hydroxide or by pH determinations. In order to maintain the free sulfuric acid within the broad ranges of about 0.2 to about 45 g/l the pH should be controlled between about 0.5 and about 3.5 and preferably between about 1.0 and about 3.0 which approximately corresponds to a free sulfuric acid concentration of from about 1.8 to about 18 g/l. The hydrogen peroxide concentration levels are advantageously monitored by conventional titration with ceric ammonium sulfate. The silicate ($SiO_2$) consumption is relatively small compared to the consumptions of either the free sulfuric acid or the hydrogen peroxide, and generally neither monitoring (which can be carried out using e.g. colorimetric principles involving the reaction of silicate with ammonium molybdate to form a yellow-colored molybdo silicate solution) nor replenishment is required during the practical life of the conversion coating bath. The rate of consumption (i.e. percent decrease in concentration per unit time) of organophosphorus additives has been found to be approximately of the same order as that of the hydrogen peroxide consumption. Therefore, replenishments of the solutions with these additives are suitably carried out at the time of hydrogen peroxide replenishment in amounts proportional to the hydrogen peroxide addition. The dye generally does not need to be replenished during the practical lifetime of the conversion coating bath. Monitoring of the color depth quality of the coating is easily carried out by visual inspection of the coated article and comparison against a reference color.

The following examples are provided to illustrate but not to limit the invention.

The general procedures used in the examples for preparing the conversion coating solutions, test specimens and forming the conversions coatings are described below.

The aqueous conversion coating solutions were each prepared to contain 2.4 g/l free $H_2SO_4$, 16.2 g/l $SiO_2$, 11.7 g/l $H_2O_2$. The $SiO_2$ ingredient was added in the form of sodium silicate ($SiO_2$=33.2% w/w; $Na_2O$=13.85% w/w) and a sufficient excess of sulfuric acid was provided to result in the indicated free $H_2SO_4$ content after neutralization of the $Na_2O$ in the sodium silicate.

Standard Hull cell steel panels (10 cm×6.8 cm×0.03 cm) were plated with zinc using a cyanide electrolyte. After thorough rinsing and drying, the samples were then immersed for 20 seconds (unless otherwise noted) in the conversion coating solution maintained at room temperature. The treated samples were then rinsed in water and then dried with a hot air gun.

COMPARATIVE EXAMPLES 1–8

A number of conversion coating solutions containing various blue dyes were prepared and tested for color and hydrogen peroxide stability after 24 and 90 hours storage. Table 1 below identifies the dyes, shows the dye concentrations and the results of the stability testing. Of the seven dyes tested in this series only those of Examples 4 and 8 did not appear to promote peroxide consumption of the bath nor undergo an undesired color change. These dyes were therefore used for conversion coating trials to determine if they would impart a desired blue color to zinc plates treated with the respective solutions. Results of 20 second immersion in each of the two baths were that no permanent color was imparted to the surface of the test panels.

TABLE 1

| Comp. Ex. No. | Dye | Dye Concentration g/l (ml/l) | Initial Bath Color | After 24 hours Bath Color | After 24 hours % $H_2O_2$ Retention | After 90 hours Bath Color | After 90 hours % $H_2O_2$ Retention |
|---|---|---|---|---|---|---|---|
| 1 | None | — | Pale Yellow | Pale Yellow | 95 | Pale Yellow | 94 |
| 2 | Chromate Blue #1(1) | 0.1 | Blue | Purple | 88 | Yellow | 81 |
| 3 | Chromate Turquoise #5(1) | 0.1 | Turquoise | Green | 86 | Pale Yellow | 66 |
| 4 | Blue #7(2) | 0.1 | Greenish Blue | Greenish Blue | 94 | Greenish Blue | 94 |
| 5 | MERPACYL ® Blue SW(3) | (0.5) | Blue | Pink | 94 | Colorless | 89 |
| 6 | PONTAMINE ® Blue AB(3) | (0.5) | Dark Blue | Dark Blue | 92 | Pale Violet | 85 |
| 7 | BRILLIANT BOND ® Blue A(3) | (0.5) | Blue | Blue | 95 | Blue | 83 |
| 8 | SEVRON ® Blue 5G(3) | (0.5) | Dark Blue | Dark Blue | 93 | Dark Blue | 91 |

(1)Conversion coating dyes from Sandoz Colors and Chemicals, NJ
(2)Conversion coating dye from Pavco Inc., Cleveland, OH
(3)Obtained from E. I. DuPont de Nemours and Company

EXAMPLES 9–11

In Example 9 the procedures of the previous comparison examples were followed exactly except that the dye was Basic Violet 3, which is a cationic triarylmethane dye having a Colour Index of 42555. The particular dye used in this example was Paper Blue R solution obtained from E. I. DuPont de Nemours provided in the form of an aqueous acetic acid solution of about 1.115 sp.gr. and a solids content of about 50 wt. %. When 0.5 ml/l of the dye solution was added to the bath there resulted a dark blue color which after 90 hours of storage did not change. The peroxide concentration was not significantly affected after conclusion of the testing (92% retention vs 94% without any dye).

Results of 20 second immersion coating tests in the dyed bath of zinc plated test panels showed a permanent reddish blue color to the surface. Repeating the immersion coating tests with varying concentrations of the dye from 0.1 to 0.5 ml/l showed that any desired depth of color could be imparted to the surface merely by changing the dye concentration.

Examples 10 and 11, in which the triarylmethane dyes were respectively a Basic Blue 7 (C.I. 42595) and Basic Green 4 (C.I. 42000), showed the same successful coloration in the concentration range used in Example 9.

EXAMPLE 12

In this example the conversion coating solution contained 0.85 g/l (dry basis) of 1-hydroxyethylidene-1,1-diphosphonic acid as a further promoter for corrosion resistance. The dyes used were a mixture of Basic Blue 7 and Basic Violet 3 (0.2 ml/l DuPont Victoria Pure Blue BOP Solution, and 0.1 ml/l DuPont Paper Blue R Liquid). Hull cell panels plated in a small scale as well as commercially plated clamps and elbow brackets served as zinc-plated specimens for conversion coating, which was carried out for 20 seconds.

Visual examination of the coated specimens showed a desirable blue color of excellent uniformity and shade, closely matching those obtained with conventional blue chromate treatment.

What is claimed is:

1. A conversion coating solution which comprises an aqueous solution of from about 0.2 g/l to about 45 g/l of free $H_2SO_4$, from about 1.5 g/l to about 58 g/l of $H_2O_2$, from about 3 g/l to about 33 g/l of $SiO_2$ and an effective amount of at least one cationic triarylmethane dye.

2. The solution of claim 1, wherein the free $H_2SO_4$ concentration is between about 1.8 g/l and about 18 g/l.

3. The solution of claim 1, wherein the $H_2O_2$ concentration is between about 7 g/l and about 29 g/l.

4. The solution of claim 1, wherein the $SiO_2$ concentration is between about 8 g/l and about 18 g/l.

5. The solution of claim 1, in which the $SiO_2$ is provided in the form of sodium silicate or potassium silicate.

6. The solution of claim 5, wherein the molecular ratio of $SiO_2$ to either $Na_2O$ or $K_2O$ in the sodium silicate or potassium silicate is maintained between about 1 and about 4.

7. The solution of claim 6, wherein said molecular ratio is at least about 2.2.

8. The solution of claim 1, containing from about 0.15 g/l to about 10 g/l of a promoter additive or mixtures of promoter additives selected from organophosphorus compounds having the general formula:

$$[X(R_1)_m]_n[R_2]_p[X(R_1)_m]_q,$$

wherein

X is a group of the formula $$Z_1O-\underset{\underset{O}{\|}}{\overset{|}{P}}-OZ_2$$

in which $Z_1$ and $Z_2$ independent from each other are hydrogen, sodium or potassium;

m is either 0 or 1;

p is either 0 or 1;

n+q is either (a) 1 when p=0, or (b) equal to the number of available bonds provided by $R_2$ when p=1;

$R_1$ is a (a) $C_1$–$C_4$ alkyl or a $C_1$–$C_4$ hydroxy-substituted alkyl and p=0; and (b) $C_1$–$C_4$ alkylene or a $C_1$–$C_4$ hydroxy-substituted alkylene and p=1;

$R_2$ is selected from (a) N≡, m=1

(b) $=N(CH_2)_rN=$, m=1 and r is an integer from 2 to 6

(c)

$$=N(CH_2)_2 \cdot \underset{\underset{X}{|}}{\underset{(R_1)_m}{N}} \cdot (CH_2)_2N=,$$

m=1, and (d) a $C_1$–$C_4$ alkylene or a $C_1$–$C_4$ hydroxy-substituted alkylene m=0 or 1.

9. The solution of claim 8, containing from about 0.5 to about 2 g/l of said organophosphorus compound.

10. The solution of claim 8, wherein the organophosphorus compound is a hydroxy alkylene diphosphonic acid.

11. The solution of claim 10, wherein the organophosphorus compound is 1-hydroxyethylidene-1,1-diphosphonic acid.

12. The solution of claim 1 in which the dye concentration ranges between about 0.05 to about 0.3 grams/liter on a dry basis.

13. The solution of claim 1, in which at least one of the dyes is Basic Violet 3 having a Colour Index of 42555.

14. The solution of claim 1, in which at least one of the dyes is Basic Blue 7 having a Colour Index of 42595.

15. The solution of claim 1, in which at least one of the dyes is Basic Green 4 having a Colour Index of 42000.

16. In a process for the formation of corrosion resistant conversion coating onto metallic surfaces selected from zinc, cadmium, silver, copper, aluminum, magnesium and zinc alloys, wherein the metallic surfaces are immersed in a conversion coating solution, and subsequently rinsed and dried, the improvement which comprises:

immersing the metallic surfaces into the conversion coating solution of claim 1.

17. In a process for the formation of corrosion resistant conversion coating onto metalic surfaces selected from zinc, cadmium, silver, copper, aluminum, magnesium and zinc alloys, wherein the metallic surfaces are immersed in a conversion coating solution, and subsequently rinsed and dried, the improvement which comprises:

immersing the metallic surfaces into the conversion coating solution of claim 8.

18. A metallic surface coated by the process of claim 16.

19. A metallic surface coated by the process of claim 17.

20. The metallic surface of claim 18, wherein the metal is zinc plate.

21. The metallic surface of claim 19, wherein the metal is zinc plate.

* * * * *

UNITED STATES PATENT AND TRADEMARK OFFICE

CERTIFICATE OF CORRECTION

PATENT NO. : 4,225,350

DATED : September 30, 1980

INVENTOR(S) : John Leslie Hugh Allan et al.

It is certified that error appears in the above-identified patent and that said Letters Patent are hereby corrected as shown below:

Column 2, line 19 - after "are" add -- no -- .

Column 4, line 24 - "12-14" should read -- 12 - 24 -- .

Column 6, line 14 - "conversions" should read -- conversion --.

Claim 17, line 2 - "metalic" should read -- metallic -- .

Signed and Sealed this

*Twenty-fourth* Day of *February 1981*

[SEAL]

*Attest:*

RENE D. TEGTMEYER

*Attesting Officer*

*Acting Commissioner of Patents and Trademarks*